US009365063B1

(12) United States Patent
Thayer

(10) Patent No.: US 9,365,063 B1
(45) Date of Patent: Jun. 14, 2016

(54) SYSTEMS AND METHODS FOR CONTINUOUS WASTE INK FILTRATION IN IMAGE FORMING DEVICES

(71) Applicant: XEROX CORPORATION, Norwalk, CT (US)

(72) Inventor: Bruce E. Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/641,893

(22) Filed: Mar. 9, 2015

(51) Int. Cl.
*B41J 2/44* (2006.01)
*B41J 29/17* (2006.01)
*B41J 2/175* (2006.01)

(52) U.S. Cl.
CPC ..... *B41J 29/17* (2013.01); *B41J 2/17563* (2013.01); *B41J 2/442* (2013.01); *G03G 2221/0005* (2013.01); *G03G 2221/0052* (2013.01); *G03G 2221/0084* (2013.01); *G03G 2221/1618* (2013.01)

(58) Field of Classification Search
CPC ..... B41J 2/435; B41J 29/17
See application file for complete search history.

(56) References Cited

U.S. PATENT DOCUMENTS

2007/0235132 A1* 10/2007 Park et al. ..... 156/345.11
2008/0093277 A1* 4/2008 Armour ..... 210/108
2009/0116876 A1* 5/2009 Nishiyama et al. ..... 399/238
2012/0103212 A1 5/2012 Stowe et al.
2013/0327237 A1* 12/2013 Jia et al. ..... 101/217

* cited by examiner

*Primary Examiner* — Kristal Feggins
*Assistant Examiner* — Kendrick Liu
(74) *Attorney, Agent, or Firm* — Ronald E. Prass, Jr.; Prass LLP

(57) ABSTRACT

A filtration system, mechanism and method is proved that continuously filters waste fluid from variable data ink-based printing system cleaning subsystems. Waste fluid from a cleaning subsystem is forced through a bank of progressively finer filter media. Initial coarse filters remove large components of the ink and/or skin that would rapidly clog the later finer filters required to remove small components of the ink and/or skin. The filtered fluid is recycled for printing surface cleaning and filtration. To avoid clogging, the filter media are cleaned by reversing the flow of fluid through the filters. This back-flushing operation is accomplished with a relatively small volume of fluid that is routed as concentrated waste fluid to a waste container for disposal. To avoid disruption to the printing process, two or more filter banks are preferably used. While one filter bank is filtering the waste fluid any other bank(s) may be back-flushed.

17 Claims, 3 Drawing Sheets

SYSTEMS AND METHODS FOR CONTINUOUS WASTE INK FILTRATION IN IMAGE FORMING DEVICES

BACKGROUND

1. Field of the Disclosed Embodiments

This disclosure relates to systems and methods for waste ink continuous filtration in liquid ink image forming or production devices, including and particularly to a waste ink filtration system and method that continuously filters ink and/or skin out of cleaner waste fluid and cleans the filters without disruption in the liquid ink image forming or printing process.

2. Related Art

Digital printing is generally understood to refer to systems and methods in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface.

"Ink-based digital printing" or "digital offset printing" systems and methods may include an ink jetting process in which a piezoelectric ink jet print head may be used to apply ink to an imaging member, in particular, an intermediate transfer component (e.g., roll, drum, belt). The jetted ink may be disposed on a pre-coat layer of liquid solution commonly be referred to as "skin", which may primarily consist of a combination of a starch, a surfactant and water. Skin may also consist of a combination of starch, a surfactant and glycerin. In particular, skin is also known in the form of a partially dried mixture of polymeric binder, liquids and release agent, such as oil, that is capable of supporting the printed intermediate image for subsequent transfer to an image receiving media substrate. The skin layer may require different levels of drying prior to suitability to apply the jetted ink. The intermediate image is transferred by contact between a surface of an intermediate transfer component and the image receiving media substrate, typically with the assistance of a pressure roller or drum to create a transfer nip.

In these variable data lithography printing systems, ink-based digital printing systems, and digital offset printing systems, which are also referred to hereinafter as variable data ink-based printing systems or variable data ink-based image forming devices, the printing surface supports an image that is only printed once and is then refreshed. These systems require cleaning subsystems at the intermediate transfer component after the transfer nip to continuously remove post transfer residual ink and/or skin from the reimageable surface of the intermediate transfer component prior to formation of the next print image and to avoid ghosting. The cleaning subsystems use a cleaning solution to aid in removal of the transfer residual ink and/or skin. During the printing process, waste stream of dilute ink and/or skin in cleaning solution continuously flows from the cleaner housing. For safety and environmental reasons, the ink and/or skin must be properly disposed, typically under contract with a printing waste disposal company to collect and dispose of the printing waste materials. These contracts are expensive and can interrupt the printing process. The inventor recognized the need for a more economical approach.

The need to filter a waste fluid stream does not exist with traditional printing technologies. In traditional printing technologies the printing surface contains a static image that generates many prints. It doesn't matter if some ink fails to transfer from the printing surface to the print media on the first pass, because the same image will appear on all of the prints. Cleaning of the printing surface in traditional printing is not continuous. Cleaning is done when the printing press is shut down. Some automatic cleaning systems are available to clean the printing surface, but cleaning is still done while the press is stopped. The waste materials from these cleaning operations need to be disposed of properly, but the volume of waste is much smaller than in a continuously cleaning processes of variable data ink-based image forming devices, which print variable images that can change from one print to the next. If the untransferred ink is not removed it may show as a ghost image on the next print with a different image. Accordingly, continuously cleaning the reimageable printing surfaces within variable data lithography printing systems, ink-based digital printing systems, and digital offset printing systems produces a high volume of waste material far greater than intermittent cleaning of traditional printing systems because the printing waste material is generally contained within the flow of cleaning solution.

SUMMARY OF DISCLOSED SUBJECT MATTER

This summary is provided to introduce a selection of concepts in a simplified form that are further described below in the detailed description. This summary is not intended to identify essential features of the claimed subject matter, nor is it intended for use in determining the scope of the claimed subject matter.

According to aspects illustrated herein, there is provided a system, technique, method and/or process for a waste ink filtration system and method that continuously filters ink and/or skin out of cleaner waste fluid and cleans the filters without disruption in the liquid ink image forming or printing process. The embodiments include a filtration system, mechanism and method that continuously filter waste fluid from variable data ink-based printing system cleaning subsystems. Waste fluid from the cleaning subsystems is forced through a bank of progressively finer filter media. Initial coarse filters remove large components of the ink and/or skin that would rapidly clog the later finer filters required to remove small components of the ink and/or skin. The filtered fluid is recycled for printing surface cleaning and filtration. To avoid clogging, the filter media are cleaned by reversing the flow of fluid through the filters. This back-flushing operation is accomplished with a relatively small volume of fluid that is routed as concentrated waste fluid to a waste container for disposal. To avoid disruption to the printing process, two or more filter banks are preferably used. While one filter bank is filtering the waste fluid any other bank(s) may be back-flushed.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing advanced stripping of image receiving media substrates, including and particularly those substrates involved in any cut-sheet image forming process in an image forming device that includes a pressure nip necessitating an ability to reliably remove the sheets of image receiving media substrate from a conformable belt and/or roller surface, will be described, in detail, with reference to the following drawings, in which like referenced numerals designate similar or identical elements, and.

DETAILED DESCRIPTION OF THE DISCLOSED EMBODIMENTS

Figure 1:
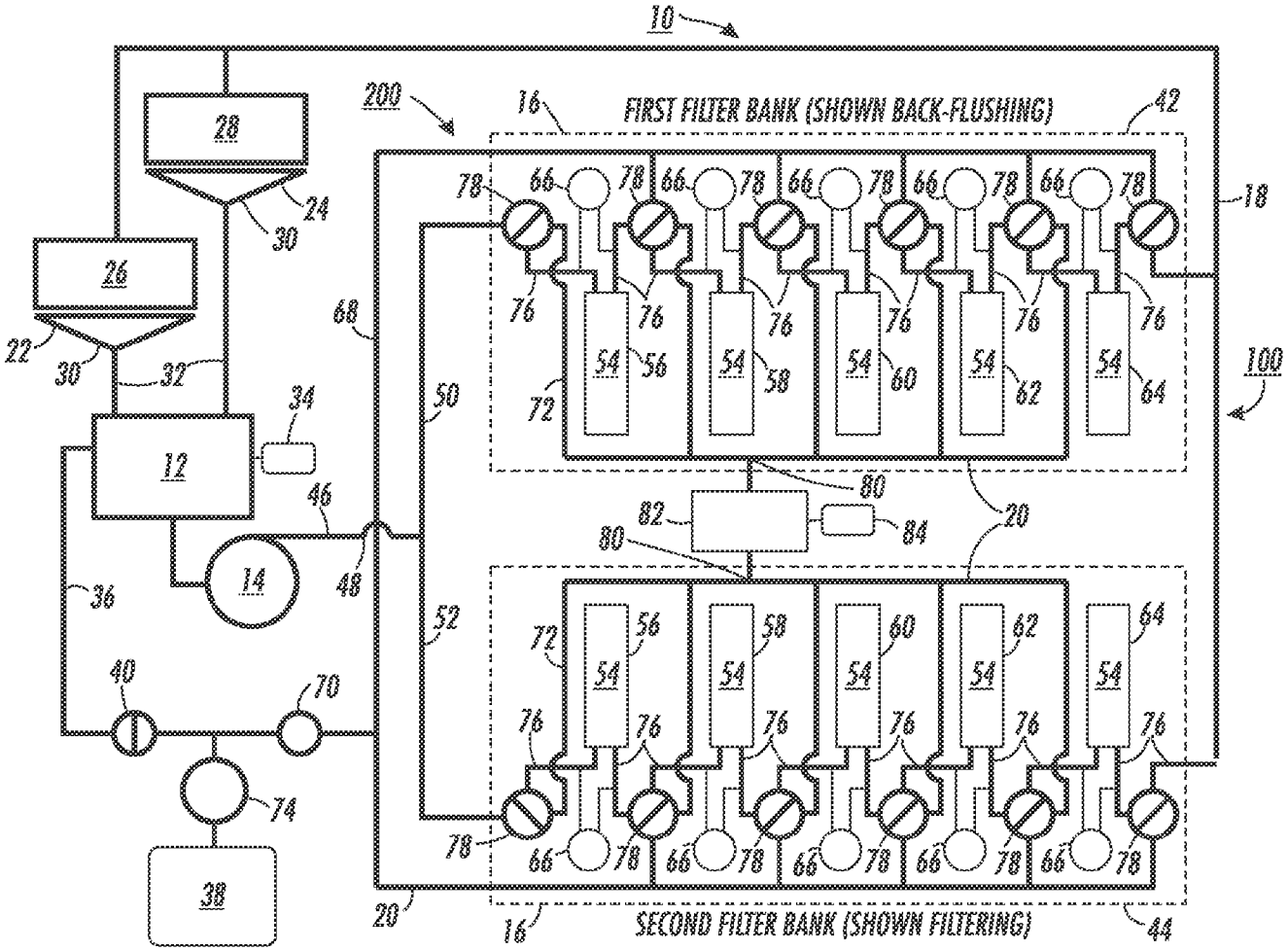
FIG. 1 illustrates a schematic diagram of an exemplary embodiment of a waste ink continuous filtration mechanism in or with variable data ink-based printing systems according to this disclosure.

The present invention will be illustrated in more detail with reference to the accompanying drawings, and which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. It should be recognized that any advantageous use of the systems and methods for implementing a filtration approach intentionally designed to continuously filter waste ink from a variable data printing system is contemplated.

The systems and methods according to this disclosure will be described as being particularly adaptable to use for continuously filtering and recycling cleaning solution used to remove ink and/or skin from intermediate transfer components (e.g., roll, drum, belt) of image forming devices. These references are meant to be illustrative only in providing a single real-world utility for the disclosed systems and methods, and should not be considered as limiting the disclosed systems and methods to any particular product or combination of devices, or to any particular type of image forming device in which the described and depicted image receiving media transport systems may be used. Any commonly-known processor-controlled variable data ink-based image forming device is contemplated.

During the printing process of variable data ink-based printing systems preferably contemplated with the exemplary embodiments cleaning subsystems may continuously remove post transfer residual ink and/or skin from the reimageable surface of the intermediate transfer component prior to formation of the next print image and to avoid ghosting. The cleaning subsystems use a cleaning solution to aid in removal of the residual ink and/or skin. The cleaning solution may also aid in removal of paper debris remaining after ink transfer from the intermediate transfer component to an image receiving media substrate at a transfer nip. This use creates a waste stream of paper debris, dilute ink and/or skin in the cleaning solution that continuously flows from the cleaner housing.

The exemplary embodiments provide the benefit of cleaning the waste stream and recycling the cleaning solution back to the cleaning subsystems for continued use with a filtration system. The waste fluid is pressurized by a pump and forced through a bank of filters structured, for example, in serial as progressively finer filter media. While not being limited to a particular theory, the number of filters or filter stages required in the filter bank depends on the materials being filtered from the cleaning solution. Initial coarse filters are preferably used to remove larger components of the ink and/or skin that would rapidly clog later finer filters required to remove smaller components of the ink and/or skin. At each filter stage the filtered material remains on the surface of the filter media and the cleaning solution and smaller waste material pass through the filter. The progressively filtered waste fluid then flows into the next filter stage to remove more waste material with a finer filter media. At the final filter stage, the fluid flowing through the filter has been sufficiently cleaned of the waste material to be reused for printing surface cleaning and then passed through another filter cycle.

Paper debris typically includes paper fibers and paper fillers. The paper fibers are relatively large and separated from the waste fluid with coarse filters. Paper fillers are typically clays and similar materials that can also be filtered with relatively coarse filters. Skin may include of starch, glycerin/water and surfactant(s). Finer filters may be required to filter skin out of the waste fluid, although starch is a fairly large molecule. Ink includes colorants suspended in a carrier fluid along with stabilizers, etc. The colorants can be either pigment particles or dyes. The ink may include dyes in water. Separating dyes from water requires a very fine filtration process, for example, nanofiltration or reverse osmosis. Passing the waste fluid of contaminated cleaning solution through progressively finer filters insures that the finest filters are not immediately clogged by the large particles/molecules in the initial waste fluid.

After a period of use, the filters will start to clog with the waste material accumulating on the filter media surface. The filtering characteristics or capabilities of each filter bank are preferably monitored, for example, via pressure sensor that measure a pressure drop across each filter in the banks. In this example, clogging progression may be indicated by an increase in pressure drop across a filter. To avoid total plugging of the filter system the filter media are cleaned by reversing the flow of fluid through the filters. This back-flushing operation may be accomplished with a relatively small volume of fluid (e.g., cleaning solution) that is then routed to a waste container as concentrated waste liquid. With this approach, the waste container contents are a much higher concentration of waste ink and/or skin in the back-flush fluid than the recycled cleaner fluid flowing through the cleaner. This concentrated waste liquid is then disposed of, for example, by a waste disposal company.

The waste filtration system of the exemplary embodiments is designed to provide efficient filtration of the cleaner waste fluid stream with minimum cost and without disruption of the printing operation. While not being limited to a particular theory, the number of stages in the filter bank and the size of the filters are preferably minimized to minimize filter cost. Minimizing the number of filters, which must still include finer filters that filter smaller ink and/or skin particles, means that clogging occurs sooner than in filter banks having more progressively finer filters. This requires more frequent back-flushing to clean the filter media. If the printing process must be halted during the back-flushing operation, printing productivity is reduced. To avoid a loss in productivity, the exemplary embodiments use two or more filter banks. While one filter back is filtering the waste fluid the other bank(s) can be back-flushed. This is all preferably provided in a single system that combines multiple fluid subsystems in an integrated filtering mechanism. For example, one fluid subsystem may be a filter recycling subsystem also referred to as a cleaning solution recycling loop, and another fluid subsystem may be a waste discharge subsystem. The continuous filter system may include valves to direct fluid flow so the filtration/back-flushing process can occur with no disruption to the printing process. The structural components of the exemplary embodiments are sized and made of materials commonly known to provide the functions and benefits of the components.

Exemplary embodiments may employ a variable data ink-based printing system waste ink continuous filtration mechanism including a waste collection container, a pump, a plurality of filter banks, a return line, a back-flush line and a concentrated waste disposal container. The waste collection container may be a waste sump configured in fluid communication with a cleaning subsystem of a variable data ink-based printing system to collect waste fluid from the cleaning subsystem. Preferably, the waste fluid includes transfer residual components diluted or suspended in a cleaning solution, and the transfer residual components include ink, skin and paper debris. The pump is coupled to the waste collection container and intentionally structurally designed to force the waste fluid from the waste container as a pressurized waste cleaning solution flow. The plurality of filter banks is intentionally structurally designed to receive the pressurized waste cleaning solution flow in a first direction and produce a filtered cleaning solution output as a filtering operation. Each filter bank includes a plurality of filters connected in series, with each filter intentionally structurally designed to collect at least a portion of the transfer residual components from the pressurized waste cleaning solution flow. The return line is coupled to each of the filter banks for fluid communication with the cleaning subsystem of the variable data ink-based printing system to recycle the filtered cleaning solution output to the cleaning subsystem. The back-flush line is in liquid communication with a back-flush liquid supply and with each filter bank to remove the collected transfer residual components from the filters by flowing back-flush liquid from the back-flush liquid supply through the filters in a second direction opposite the first direction as a back-flush operation to produce a concentrated waste liquid. The back-flush line includes an outlet configured to communicate with a concentrated waste container and dispose the concentrated waste liquid back-flush to the concentrated waste container.

Exemplary embodiments may employ a variable data ink-based printing system having the waste ink continuous filtration mechanism. Variable data ink-based printing systems are also referred to as variable data ink-based image forming devices.

Exemplary embodiments may employ a method of continuously filtering waste ink from a variable data ink-based printing system. While not being limited to a particular theory, an exemplary method includes collecting waste fluid from a cleaning subsystem of a variable data ink-based printing system to waste collection container in fluid communication with the cleaning subsystem, with the waste fluid including transfer residual components diluted or suspended in a cleaning solution, and the transfer residual components including ink, skin and paper debris. The exemplary method also includes pumping the waste fluid from the waste container as a pressurized waste cleaning solution flow. The exemplary method further includes filtering the pressurized waste cleaning solution flow in a first direction via a plurality of filters connected in series in at least one of a plurality of filter banks to produce a filtered cleaning solution output, with each filter collecting at least a portion of the transfer residual components from the pressurized waste cleaning solution flow. The exemplary method yet further includes recycling the filtered cleaning solution output to the cleaning subsystem of the variable data ink-based printing system via a return line coupled to each of the filter banks. The exemplary method still further includes removing the collected transfer residual components from the filters by flowing back-flush liquid from a back-flush liquid supply through the filters in a second direction opposite the first direction via a back-flush line in liquid communication with the back-flush liquid supply and with each filter bank to produce a concentrated waste liquid. The exemplary method yet still further includes disposing the concentrated waste liquid back-flush to a concentrated waste container.

FIG. 1 illustrates a schematic diagram depicting an exemplary embodiment of a waste ink continuous filtration mechanism 10 applicable in or with variable data ink-based printing systems. The filtration mechanism 10 is intentionally designed to couple to the cleaning systems of variable ink-based printing systems via fluid communication there between. The filtration mechanism 10 combines multiple fluid subsystems in an integrated system including a waste collection container (e.g., waste sump 12), a pump 14, a plurality of filter banks 16, a return line 18, and a back-flush line 20. The filtration mechanism 10 may also include motors, sensors and valves in communication with a controller (not shown) of the printing system to aid in the automatic operation of the filtration mechanism, for example, as discussed in greater detail below. The controller may include a processor and control unit designed to initiate, monitor and control the operation of the filtration mechanism and the printing system, as well understood by a skilled artisan.

The waste collection container may be a waste sump 12 configured in fluid communication with a cleaning subsystem (e.g., transfer roll cleaner 26, belt cleaner 28, cleaning subsystem 370 (FIG. 3)) of a variable data ink-based printing system to collect waste fluid from the cleaning subsystem. The waste fluid includes transfer residual components (e.g., ink, skin) diluted in a cleaning solution. The waste fluid may also include transfer residual components that are not diluted, but held in suspension within the cleaning solution, for example, paper debris. FIG. 1 depicts this fluid communication via input connectors 22 and 24 that receive the waste fluid from ink and/or skin removing units of the cleaning subsystem coupled to an intermediate transfer component (e.g., roll, drum, belt) as readily understood by a skilled artisan. In particular, the input connector 22 is shown in fluid communication with the transfer roll cleaner 26 and the input connector 24 in fluid communication with the belt cleaner 28. While not being limited to a particular theory, such ink and/or skin removing units may include tacky or non-tacky foam rolls, hard rolls, blades, air knives, cleaner housings and other known ink and skin removing elements. The cleaning subsystem may also include motors (e.g., drive, stepper, pneumatic) as needed to drive and engage the ink or skin removing elements as readily understood by a skilled artisan. For example the transfer roll cleaner 26 and belt cleaner 28 may include a drive motor for a foam roll, a stepper motor to engage and retract a blade, and a stepper or pneumatic motor to engage and retract a cleaner housing.

The input connectors 22, 24 include waste fluid receiving units 30 and conduits 32 coupled to the waste sump 12, which is a temporary housing for the waste fluid. The waste sump 12 may include a fluid level sensor 34 that measures the level of fluid in the waste sump to maintain a level of fluid in the filtration mechanism 10 for continuous fluid flow therein, as well understood by a skilled artisan. In order to maintain a sufficient amount of fluid in the waste sump 12, a sump fill conduit 36 is coupled to the waste sump and to a source of cleaning solution (e.g., cleaning solution supply 38) that adds cleaning solution to the waste sump as needed. A sump fill valve 40 is provided in the sump fill conduit 36 as a two port valve to control the amount of cleaning solution added to the waste sump 12. The waste sump is coupled to the pump 14 via a conduit.

The pump 14 is intentionally structurally designed to force the waste fluid from the waste sump 12 as a pressurized waste cleaning solution flow. Specifically, the pump 14 may include a motor that draws the waste fluid from the waste sump and pumps the fluid through the filter banks 16 and back to the cleaning subsystem of the printing station in a closed loop intended to maintain fluid flow to the cleaning subsystem.

The filter banks 16 are intentionally structurally designed to receive the pressurized waste cleaning solution flow in a first direction through progressively finer filter media and produce a filtered cleaning solution output as a filtering operation. As can be seen in FIG. 1, the filter banks 16 may include a first filter bank 42 and a second filter bank 44, with each filter bank coupled to the pump 14 via conduit 46. In particular, conduit 46 is shown having a single input section 48 that opens into output sections, with each output section coupled to a respective filter bank 16. For example, the input section 48 splits into first and second output sections 50 and 52, with the first output section 50 coupled to the first filter bank 42 and the second output section 52 coupled to the first filter bank 44.

Each filter bank 16 may include a plurality of filters 54 connected in series via liquid conduits 76, with each filter having a filter media that collects at least a portion of the transfer residual components from the pressurized waste cleaning solution flow stemming from the pump 14. While not being limited to a particular theory, preferably the filter media is a surface filter, or solid sieve that traps oversize particles in the pressurized waste cleaning solution flow feed. As such, the filter media may be made of a non-corrosive durable material (e.g., stainless steel, aluminum, plastics, nylon). The filter media may also be a depth filter having a bed of granular material. It is understood that each filter 54 may represent any number or combination of lattice structures that may be integrated into a filter stage.

Still referring to FIG. 1, the filter banks 16 are shown having five filters 54, with each successive filter designed with a finer lattice structure or media to block smaller waste components from the waste fluid. For example, with each filter bank 16 having five filters 54 referred to specifically as first filter 56, second filter 58, third filter 60, fourth filter 62 and fifth filter 64, the fifth filter 64 has the finest filter media, followed by the fourth filter 62, then the third filter 60, then the second filter 58 and finally the first filter 56 with the least restrictive finer filter media. With this exemplary construction, the first filter 56 may be used to filter waste components (e.g., paper debris) larger than ink or skin out of the waste fluid. Based on a consideration that skin components are larger than ink components, the second filter 58 may be used as an initial or less restrictive skin filter, and the third filter 60 may be used as a final or more restrictive skin filter. Further, the fourth filter 62 may be used as an initial or less restrictive oil filter, and the fifth filter 64 may be used as a final stage or more restrictive oil filter. It is understood that the filter banks are not limited to any particular number of filters 54. Preferably the number of filters 54 is minimized for cost to provide efficient filtration of the waste fluid, with each filter removing some share of the waste fluid transfer residual components. Accordingly the number of filters 54 in each filter bank 16 is preferably less than 50 and most preferably less than 10.

After final filter stage the fluid flowing through the last filter in the filter bank 16 (e.g., filter 64) has completed a filter cycle with enough waste material removed to be reused as filtered cleaning solution for printing surface cleaning and then another filter cycle. Each filter bank 16 is coupled to the return line 18 (e.g., conduit(s), pipe(s), tube(s), hose(s), channel(s), combination or array thereof) in fluid communication with the cleaning subsystem of the variable data ink-based printing system to recycle the filtered cleaning solution to the cleaning subsystem. The return line 18 completes a filter recycling subsystem also referred to in the exemplary embodiments as a cleaning solution recycling loop 100 that further includes the cleaning subsystem, waste sump 12, pump 14, filter banks 16 and fluid communicating conduits there between as discussed above.

After some amount of filtration, the filters 54 will start to clog with the waste material accumulating on the filter media, thereby reducing the efficiency of the filters. In order to monitor the clogging progression of the filters, the filter banks 16 include sensors that measure filtering characteristics of each filter bank. The pressurized waste cleaning solution flows through the filters 54 due to a difference in pressure between the higher pressure side before each filter and the lower pressure side after the filter. The filtering characteristic of clogging may be indicated by an increase in pressure drop $\Delta P$ across the filter. To measure pressure drop $\Delta P$ across the filters 54, a pressure sensor 66 is attached to the input and output of each filter, as readily understood by a skilled artisan. When a sensor 66 detects that the pressure differential across a filter is at a level indicating that the filter is clogged sufficiency to inhibit output of the filtered cleaning solution back to the cleaning subsystem of the printing system, the filters of the respective filter bank are back-flushed to prevent clogging, for example, as will be described in greater detail below. In an exemplary approach, the sensors 66 are in communication with a controller of the printing system, and the controller signals the filter bank to backwash the filters 54.

The filtration mechanism 10 further includes a waste discharge subsystem 200 that cleans the filters 54. For example, the waste discharge subsystem 200 removes the filtered waste components from the filters 54 by backwashing. As can be seen in FIG. 1, the waste discharge subsystem 200 includes the back-flush line 20 (e.g., conduit(s), pipe(s), tube(s), hose(s), channel(s), combination or array thereof), which has a first section 68 thereof in fluid communication between a source of back-flush liquid (e.g., cleaning solution supply 38 via a back-flush valve 70) and each filter bank 16 to remove the filtered waste components (e.g., transfer residual components) from the filters 54. Specifically, the first section 68 of the back-flush line 20 is coupled in parallel to each filter 54 via liquid conduits 76 and transfers the back-flush liquid from the back-flush liquid supply into the output of each filter in a flushing direction opposite the direction of the pressurized waste cleaning solution flow as a back-flush operation to produce a concentrated waste liquid of the filtered waste components and back-flush liquid. The back-flush line 20 also has a second section 72 coupled to the input of each filter 54 via liquid conduits 76 for receipt of the concentrated waste liquid for disposal.

While not being limited to a particular theory, the back-flush liquid is cleaning solution provided from the cleaning solution supply 38. In this example, the cleaning solution supply 38 provides cleaning solution for both the cleaning solution recycling loop 100 and the waste discharge subsystem 200. The sump fill valve 40 and the back-flush valve 70 control flow of the cleaning solution from the cleaning solution supply 38. Preferably the pump 14 provides sufficient pressure to the cleaning solution recycling loop 100 and the waste discharge subsystem 200 to move the flow of cleaning solution as released by the sump fill and back-flush valves. A pump 74 may be attached in fluid communication with the cleaning solution supply to transfer the cleaning solution from the cleaning solution supply 38, for example, if fluid pressure provided by the pump 14 is too low.

The back-flush valve 70 is a two port actuator valve that opens to allow pressurized cleaning solution into the back-flush line 20 and the filter banks 16. Each filter bank further includes valves 78 (e.g., actuators, switches, solenoid valves, that control the direction of flow through the filter bank in either the first direction for filtering, or the second direction for back-flushing. FIG. 1 shows an example of a valve 78 located at the input and output of each filter 54 in communication with the liquid conduits 76 and with the back-flush line 20. For example, a first one of the valves 78 at each filter bank 16 may be a three-port valve located in fluid communication between conduit 46 of the cleaning solution recycling loop 100 and liquid conduit 76 coupled to the input of the first filter 56. The same first one of the valves 78 is also in fluid communication with the second section 72 of the back-flush line 20. A second one of the valves 78 at each filter bank 16 may also be a three-port valve located in fluid communication between a liquid conduit 76 coupled to the output of the last filter 64 and the return line 18, an further in fluid communication with the first section 68 of the back-flush line 20. Other valves 78 located between the filters 54 are four port valves in fluid communication with the liquid conduit 76 between the filters and also in fluid communication with the back-flush line 20 between the first section 68 and the second section 72 thereof.

The valves 78 are operable in at least two positions. In a first position (e.g., filtering operation mode) exemplified by second filter bank 44, the valves 78 open the liquid conduits 76 between each filter 54, and to the conduit 46 and the return line 18 of the of the cleaning solution recycling loop 100 to enable the filter bank 16 to provide the filtering operation and shut down any back-flushing operation. In a second position (e.g., back-flushing mode) exemplified by first filter bank 42, the valves 78 closes the serial flow of the filtering operation by shutting down flow between the filters 54, opens liquid flow from the first section 68 of the back-flush line 20 separately to the output of each filter, and also opens liquid flow from the input of each filter to the second section 72 of the back-flush line. The valves 78 operating in the second position enable the backwashing or back-flushing operation to clean the filters. In the example, each of the filter banks alternatively receives the pressurized waste cleaning solution flow to produce the filtered cleaning solution output in a filtering operation, and removes the collected transfer residual components from the filters to produce the concentrated waste liquid in a back-flush operation, with at least one of the filter banks providing the filtering operation at all times during operation of the filtration mechanism 10.

The back-flush operation depicted by the first filter bank 42 is preferably accomplished with a relatively small volume of fluid in comparison to the fluid being recycled in the filtering operation. In order to keep the volume of cleaning solution used for the back-flush to a minimum amount necessary to clean the filters 54, the back-flush valve 70 is opened to pressurize the cleaning solution in the first section 68 of the of the back-flush line 20 and, if needed, additional cleaning solution from the cleaning solution supply 38 through the back-flushing filter bank 42. After a period of time the back-flush valve 70 is closed to reduce the pressure in the first section and stop the back-flush operation. Preferably this period of time is long enough only to allow the cleaning solution to clean the filters 54 sufficiently for the filters to efficiently operate again in a subsequent filtering operation cycle, and no longer as any additional time would unnecessarily dilute the waste liquid. This period of time is shorter than the filtering operation cycle of the filtering bank 16, as only a small volume of fluid is needed. This results in a waste liquid more highly concentrated than the waste fluid output from the cleaning subsystem of the printing system.

The second section 72 of each filter bank 16 includes an outlet 80 downstream from the filters 54. The outlet is in fluid communication with a concentrated waste container 82 and disposes the concentrated waste liquid back-flush from the waste discharge subsystem 200 to the concentrated waste container. The concentrated waste container 82 may include a sensor 84 that indicates that the concentrated waste container is filled with liquid for removal from the filtration mechanism 10, preferably by a waste collection person or company.

Figure 2:
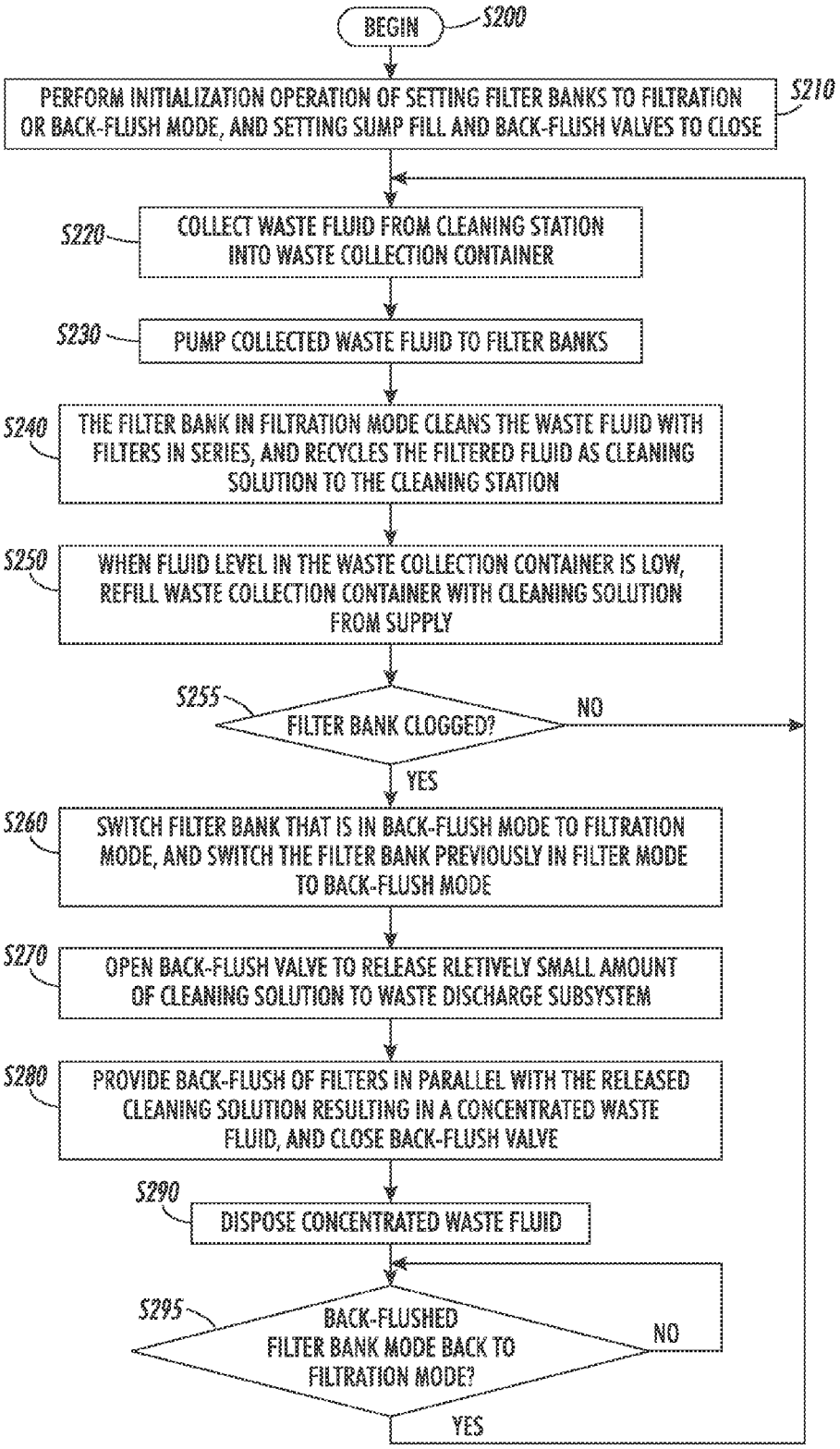
FIG. 2 illustrates a flowchart of an exemplary method for implementing the waste ink continuous filtration mechanism in or with variable data ink-based printing systems according to this disclosure.

FIG. 2 illustrates a flowchart of such an exemplary filtration method in or with a variable data ink-based printing system. As shown in FIG. 2, operation of the method commences at Step S200 and proceeds to Step S210, where one of the filter banks 16 is set to filtration mode, and one of the filter banks 16 that was not set to filtration mode in is set to back-flush mode as discussed above. Further, the sump fill valve 40 and back-flush valve 70 are set to close and the pump 14 is turned on to pressurize the cleaning solution recycling loop 100 of the filtering mechanism 10.

After the filtering mechanism initialization operation provided is Step S210, the filtering mechanism 10 collects waste fluid from a cleaning subsystem of the variable data ink-based printing system to a waste collection container (e.g., waste sump 12) at Step S220. The waste fluid includes transfer residual components diluted in a cleaning solution, with the transfer residual components including ink and skin from a reimageable surface of an intermediate transfer component of the printing system. The waste fluid may also include transfer residual components that are not diluted, but held in suspension within the waste fluid, for example, paper debris. At Step S230, the waste fluid is urged by the pump 14 from the waste container as a pressurized waste cleaning solution flow.

At Step S240, the filter bank in filtration mode filters the pressurized waste cleaning solution flow in a first direction via a plurality of filters 54 connected in series, and outputs a filtered cleaning solution. In this step, each filter collects at least a portion of the transfer residual components from the pressurized waste cleaning solution. The filtered cleaning solution is recycled back to the cleaning subsystem of the variable data ink-based printing system via a return line 18 coupled to the filter banks. Steps S220-S240 are continuously repeated during operation of the exemplary filtration method.

During Steps S220-S240, the level of fluid in the waste sump 12 is monitored via the fluid level sensor 34 to maintain a level of fluid in the filtration mechanism 10 for continuous fluid flow therein. If the fluid level is too low to maintain pump sourced fluid pressure in the cleaning solution recycling loop, then at Step S250, the sump fill valve 40 is opened temporarily to fill the waste sump 12 with additional cleaning solution from the cleaning solution supply to a level sufficient to maintain the pump sourced fluid pressure. This added cleaning solution is mixed with the waste fluid in the waste sump 12, and cycled through the filter bank operating in filter mode and the cleaning subsystem of the printing system. Then the sump fill valve 40 is closed.

During Steps S220-S250, the filtering mechanism 10 monitors the filtering characteristics of the filter bank 16 set to filtration mode. If any of the filters in the filter bank indicate a significant loss in filter performance at Step S255, which may be indicated by an increased pressure loss across any one of the filters exceeding a threshold, then at Step S260, one of the filter banks 16 that is not in filtration mode is switched to filtration mode to continue continuous processing of Steps S220-S240, and the filter bank previously in filter mode and indicating the significant loss in filter performance is switched to back-flush mode.

At Step S270, the back-flush valve 70 is opened to add back-flush liquid (e.g. cleaning solution) under pressure to the waste discharge subsystem 200. At Step S280, the waste discharge subsystem removes the collected transfer residual components from the filters 54 in the filter bank 16 switched to back-flush mode by flowing back-flush liquid from a back-flush liquid supply (e.g., cleaning solution supply 38) through the filters in a second direction opposite the first direction via the back-flush line 20. The pressurized back-flush liquid backwashes each filter independently in parallel. The process of Step S280 cleans the filters and produces a concentrated waste liquid. After a time period long enough only to allow the back-flush liquid to clean the filters 54 sufficiently for the filters to efficiently operate again in the filter mode, the back-flus filter valve 70 is closed. At Step S290, the concentrated waste liquid is disposed into a concentrated waste container. The back-flushed filter bank then waits to be switched back to filtration mode when a filter bank operating in the filtration mode becomes sufficiently clogged and needs to be cleaned by backwashing at Step S295. Preferably Steps S270-S290 occur simultaneously with Steps S220-S250, with Steps S220-S250 processed continuously at all times during operation of the filtering mechanism 10.

The above-described exemplary systems and methods reference certain conventional components to provide a brief, general description of suitable operating and variable data ink-based image forming environments in which the subject matter of this disclosure may be implemented for familiarity and ease of understanding. Although not required, embodiments of the disclosure may be provided, at least in part, in a form of hardware circuits, firmware, or software computer-executable instructions to instruct the specific functions described in image forming and filtration systems. These may include individual program modules executed by a processor. The exemplary embodiments may include a non-transitory computer-readable medium storing instructions which, when executed by a processor, may cause the processor to execute all, or at least some, of the steps of the method outlined above.

The exemplary depicted sequence of executable instructions, or associated data structures that may execute the instructions, represent one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 2, except where a particular method step is a necessary precondition to execution of any other method step.

Figure 3:
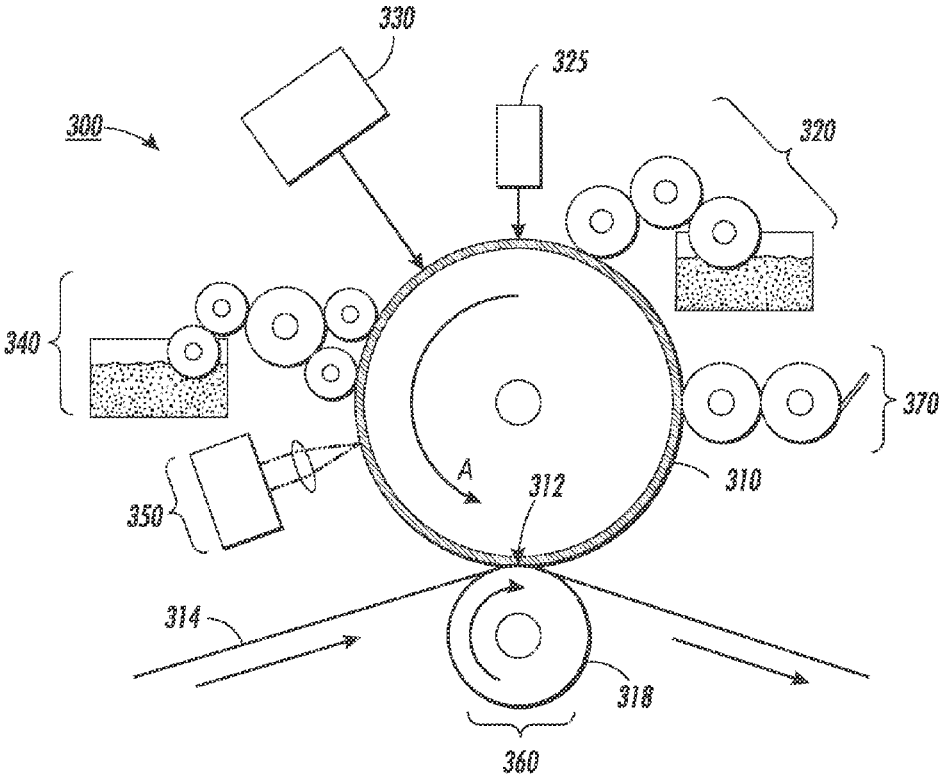
FIG. 3 RELATED ART
FIG. 3 shows a side diagrammatical view of a related art ink-based digital printing system.

U.S. Patent Application Publication No. 2012/0103212 A1 ("212 Publication"), entitled "Variable Data Lithography System," filed on Apr. 27, 2011 by Timothy Stowe et al., which is commonly assigned, and the disclosure of which is hereby incorporated by reference herein in its entirety, describes an exemplary variable data lithography system for ink-based digital printing that may require continuous removal of post transfer residual paper debris, ink and/or skin from an intermediate transfer component. The 212 Publication describes an exemplary variable data lithography system 300 for ink-based digital printing, such as that shown, for example, in FIG. 3. A general description of the exemplary system 300 shown in FIG. 3 is provided here. Additional details regarding individual components and/or subsystems shown in the exemplary system 300 of FIG. 3 may be found in the 212 Publication.

As shown in FIG. 3, the exemplary system 300 may include an imaging member 310. The imaging member 310 in the embodiment shown in FIG. 3 is a drum, but this exemplary depiction should not be interpreted so as to exclude embodiments wherein the imaging member 310 includes a drum, plate or a belt, or another now known or later developed configuration. The reimageable surface may be formed of materials including, for example, silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 310 is used to apply an ink image to an image receiving media substrate 314 at a transfer nip 312. The transfer nip 312 is formed by an impression roller 318, as part of an image transfer mechanism 360, exerting pressure in the direction of the imaging member 310. Image receiving medium substrate 314 should not be considered to be limited to any particular composition such as, for example, paper, plastic, or composite sheet film. The exemplary system 300 may be used for producing images on a wide variety of image receiving media substrates. The 212 Publication also explains the wide latitude of marking (printing) materials that may be used, including marking materials with pigment densities greater than 10% by weight. As does the 212 Publication, this disclosure will use the term ink to refer to a broad range of printing or marking materials to include those which are commonly understood to be inks, pigments, and other materials which may be applied by the exemplary system 300 to produce an output image on the image receiving media substrate 314.

The 212 Publication depicts and describes details of the imaging member 310 including the imaging member 310 being comprised of a reimageable surface layer formed over a structural mounting layer that may be, for example, a cylindrical core, or one or more structural layers over a cylindrical core.

The system 300 includes a dampening fluid system 320 generally comprising a series of rollers, which may be considered as dampening rollers or a dampening unit, for uniformly wetting the reimageable surface of the imaging member 310 with dampening fluid. A purpose of the dampening fluid system 320 is to deliver a layer of dampening fluid, generally having a uniform and controlled thickness, to the reimageable surface of the imaging member 310. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. For inks and methods of embodiments, however, suitable dampening fluids contain substantially no water, which is immiscible with the inks used in methods of embodiments. Other suitable dampening fluids contain no greater than 10% water by weight. Generally, suitable dampening fluid is a low-surface tension fluid that is not miscible with water contained in the ink. Small amounts of certain surfactants may be added to the fountain solution as well.

Once the dampening fluid is metered onto the reimageable surface of the imaging member 310, a thickness of the dampening fluid may be measured using a sensor 325 that may provide feedback to control the metering of the dampening fluid onto the reimageable surface of the imaging member 310 by the dampening fluid system 320.

After a precise and uniform amount of dampening fluid is provided by the dampening fluid system 320 on the reimageable surface of the imaging member 310, and optical patterning subsystem 330 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 310 should ideally absorb most of the laser energy (visible or invisible such as IR) emitted from the optical patterning subsystem 330 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 330 is described above as being a laser emitter, it should be understood that a variety of different systems may be used to deliver the optical energy to pattern the dampening fluid.

The mechanics at work in the patterning process undertaken by the optical patterning subsystem 330 of the exemplary system 300 are described in detail with reference to FIG. 5 of the 212 Publication. Briefly, the application of optical patterning energy from the optical patterning subsystem 330 results in selective removal of portions of the layer of dampening fluid.

Still referring to FIG. 3, following patterning of the dampening fluid layer by the optical patterning subsystem 330, the patterned layer over the reimageable surface of the imaging member 310 is presented to an inker subsystem 340. The inker subsystem 340 is used to apply a uniform layer of ink over the layer of dampening fluid and the reimageable surface layer of the imaging member 310. The inker subsystem 340 may use an anilox roller to meter an offset lithographic ink onto one or more ink forming rollers that are in contact with the reimageable surface layer of the imaging member 310. Separately, the inker subsystem 340 may include other traditional elements such as a series of metering rollers to provide a precise feed rate of ink to the reimageable surface. The inker subsystem 340 may deposit the ink to the pockets representing the imaged portions of the reimageable surface, while ink on the unformatted portions of the dampening fluid will not adhere to those portions.

The cohesiveness and viscosity of the ink residing on the reimageable layer of the imaging member 310 may be modified by using a rheology (complex viscoelastic modulus) control subsystem 350. In particular, the ink may be optional dried or heated to partially coalesce the ink using the rheological conditioning system, which may be configured for applying heat to increase the ink's cohesive strength relative to the reimageable surface layer. Cooling may be used to modify rheology as well via multiple physical cooling mechanisms, as well as via chemical cooling.

The ink is then transferred from the reimageable surface of the imaging member 310 to a substrate of image receiving medium 314 using a transfer subsystem 360. The transfer occurs as the substrate 314 is passed through a nip 312 between the imaging member 310 and an impression roller 318 such that the ink within the voids of the reimageable surface of the imaging member 310 is brought into physical contact with the substrate 314. Optional modification of the adhesion of the ink using rheology control system 350 enhances the ability of the ink to adhere to the substrate 314 and to separate from the reimageable surface of the imaging member 310. Careful control of the temperature and pressure conditions at the transfer nip 312 may allow transfer efficiencies for the ink from the reimageable surface of the imaging member 310 to the substrate 314 to exceed 95%. While it is possible that some dampening fluid may also wet substrate 314, the volume of such a dampening fluid will be minimal, and will rapidly evaporate or be absorbed by the substrate 314.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 314, any residual ink and/or residual dampening fluid must be removed from the reimageable surface of the imaging member 310, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 370, of which the filtering mechanism 10 of the embodiments may include or be attached to, for example via the cleaning subsystem (e.g., transfer roll cleaner 26, belt cleaner 28) to collect waste fluid from the cleaning subsystem 370, filter the waste fluid and return cleaning solution to the cleaning subsystem.

The 212 Publication describes details of such a cleaning subsystem 370 including at least a first cleaning member such as a sticky or tacky member in physical contact with the reimageable surface of the imaging member 310, the sticky or tacky member removing residual ink and any remaining small amounts of surfactant compounds from the dampening fluid of the reimageable surface of the imaging member 310. The sticky or tacky member may then be brought into contact with a smooth roller to which residual ink may be transferred from the sticky or tacky member, the ink being subsequently stripped from the smooth roller by, for example, a blade.

The 212 Publication details other mechanisms by which cleaning of the reimageable surface of the imaging member 310 may be facilitated. Regardless of the cleaning mechanism, however, cleaning of the residual ink and dampening fluid from the reimageable surface of the imaging member 310 is essential to preventing ghosting in the proposed system. Once cleaned, the reimageable surface of the imaging member 310 is again presented to the dampening fluid system 320 by which a fresh layer of dampening fluid is supplied to the reimageable surface of the imaging member 310, and the process is repeated.

An exemplary variable data ink-based printing system that may include a waste ink continuous filtration mechanism or system of the exemplary embodiments may use non-aqueous offset printing inks. As noted above, a very thin dampening fluid layer may be applied to the imaging drum and then selectively evaporated to form a latent image in the dampening fluid layer. An ink coated roller may transfer ink to the imaging drum or member at areas without fountain solution and not transfer in areas with dampening fluid. The ink image is then transferred to print media, such as paper. Ink remaining on the imaging drum after transfer may be transferred to a smooth, high surface energy cleaning roller in the cleaning subsystem. Alcohols remove untransferred ink from the cleaning roll better than water alone, however, small amounts of additives to the water can provide cleaning performance as good as or better than alcohol.

Traditionally in the offset printing process, alcohol has been used to clean ink from rollers while printing is stopped. Environmental and health concerns exist with alcohol and other volatile solvents. Thus low or no volatile organic compound (VOC) cleaning solutions are typically preferred for offset ink cleaning. These low or non-VOC solutions generally require some time to penetrate the non-aqueous ink and clean the rolls, so they may not be as efficient as cleaning solutions in a variable data ink-based printing system continuous printing/cleaning process without small amounts of additives to the cleaning solution. Removal of such remaining non-aqueous ink residue may be accomplished through use of a cleaning subsystem of which the filtering mechanism 10 of the embodiments may include or be attached to.

Another exemplary variable data ink-based printing system that may include a waste ink continuous filtration mechanism or system of the exemplary embodiments may apply a water soluble skin to an image blanket or member and then jet a water soluble ink image onto the skin. Both of these layers are dried and transferred to the print media. However, not all of the water soluble skin and ink may transfer to the media, and paper debris may adhere to the image member after transfer. The cleaner subsystem may remove this waste aggregate by applying a cleaning solution that may be water or water plus a minor amount of surfactant. The water or water plus surfactant solution hydrates the skin and ink so that they can easily be wiped from the image member (e.g., blanket, drum) surface by the cleaning roller and wiper blade. At this point, the skin and ink are dissolved into the cleaning solution. Any paper debris may typically be held in suspension within the cleaning solution. The skin, ink and paper debris are the materials to be filtered out of the cleaning solution by the continuous waste ink filtration systems, mechanisms and methods discussed by example herein prior to reusing the cleaning solution.

Although the above description may contain specific details, they should not be construed as limiting the claims in any way. Other configurations of the described embodiments of the disclosed systems and methods are part of the scope of this disclosure. For example, while the exemplary embodiments described above include two filter banks 16, with one filter bank 16 filtering the cleaning solution while the other filter bank back-flushes its filters, it is understood that the embodiments include filtering mechanisms with more than two filter banks, with at least one of the filter banks providing the filtering operation and at least one of the filter banks providing the back-flushing operation. Further, there is no limitation to the number of filter banks providing either operation at any time. Those skilled in the art will appreciate that other embodiments of the disclosed subject matter may be practiced in devices, including image forming devices, of many different configurations. It will be appreciated that variations of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

What is claimed is:

1. A variable data ink-based printing system waste ink continuous filtration mechanism, comprising:

a waste collection container configured in fluid communication with a cleaning subsystem of a variable data ink-based printing system to collect waste fluid from the cleaning subsystem, the waste fluid including transfer residual components diluted in a cleaning solution, the transfer residual components including ink and skin;

a pump coupled to the waste collection container, the pump configured to force the waste fluid from the waste container as a pressurized waste cleaning solution flow;

a plurality of filter banks configured to receive the pressurized waste cleaning solution flow in a first direction and produce a filtered cleaning solution output as a filtering operation, each filter bank including a plurality of filters connected in series, with each filter configured to collect at least a portion of the transfer residual components from the pressurized waste cleaning solution flow;

a return line coupled to each of the filter banks, the return line configured for fluid communication with the cleaning subsystem of the variable data ink-based printing system to recycle the filtered cleaning solution output to the cleaning subsystem; and a back-flush line in liquid communication with a back-flush liquid supply and with each filter bank to remove the collected transfer residual components from the filters by flowing back-flush liquid from the back-flush liquid supply through the filters in a second direction opposite the first direction as a back-flush operation to produce a concentrated waste liquid, the back-flush line including an outlet configured to communicate with a concentrated waste container and dispose the concentrated waste liquid back-flush to the concentrated waste container;

wherein the back-flush liquid supply providing cleaning solution to the cleaning subsystem via the waste collection container.

2. The mechanism of claim 1, further comprising a plurality of filter valves, each of the plurality of filters being connected in series via one of the filter valves to an adjacent one of the plurality of filters within each filter bank, each filter having an input line and an output line, wherein a first filter in each filter bank is in fluid communication with the pump via a respective filter valve coupled to the input line of the respective first filter, and a last filter in each filter bank is in fluid communication with the return line and the back-flush line via a respective filter valve coupled to the output line of the respective last filter.

3. The mechanism of claim 1, the pump including a pump output line in communication with both of the filter banks, each filter of each respective filter bank being connected in series to the pump output line and in parallel to the back-flush line.

4. The mechanism of claim 1, wherein the back-flush liquid supply is coupled to the waste collection container, and the back-flush liquid is the cleaning solution.

5. The mechanism of claim 1, each of the plurality of filters including a pressure sensor to measure a pressure drop across each filter, wherein based on a determination of any pressure sensor within a respective filter bank, the filters of the respective filter bank are back-flushed to prevent clogging.

6. The mechanism of claim 1, wherein simultaneously one of the plurality of filter banks receives the pressurized waste cleaning solution flow to produce the filtered cleaning solution output, and the other one of the plurality of filter banks removes the collected transfer residual components from the filters to produce the concentrated waste liquid.

7. The mechanism of claim 1, wherein each of the plurality of filter banks is configured to alternatively receive the pressurized waste cleaning solution flow to produce the filtered cleaning solution output in the back-flush operation, and remove the collected transfer residual components from the filters to produce the concentrated waste liquid in the filtering operation, with at least one of the filter banks providing the filtering operation at all times during operation of the mechanism.

8. The mechanism of claim 1, further comprising a sump fill valve in liquid communication between the back-flush liquid supply and the waste collection container, the waste collection container having a waste fluid level sensor configured to measure the level of waste fluid in the waste collection container, the sump fill valve operatively coupled between the back-flush liquid supply and the waste collection container to allow back-flush liquid flow to the waste collection container as the cleaning solution based on the measure level of waste fluid in the waste collection container.

9. The mechanism of claim 1, each of the filter banks including a sensor configured to measure filtering characteristics of each filter bank, wherein the mechanism reverses liquid flow through one of the filter banks based on a measurement of the filtering characteristics of the one of the filter banks by the sensor.

10. A method of continuously filtering waste ink from a variable data ink-based printing system comprising:

a) collecting waste fluid from a cleaning subsystem of a variable data ink-based printing system to waste collection container in fluid communication with the cleaning subsystem, the waste fluid including transfer residual components diluted in a cleaning solution, the transfer residual components including ink and skin;

b) pumping the waste fluid from the waste container as a pressurized waste cleaning solution flow;

c) filtering the pressurized waste cleaning solution flow in a first direction via a plurality of filters connected in series in at least one of a plurality of filter banks to produce a filtered cleaning solution output, with each filter collecting at least a portion of the transfer residual components from the pressurized waste cleaning solution flow;

d) recycling the filtered cleaning solution output to the cleaning subsystem of the variable data ink-based printing system via a return line coupled to each of the filter banks;

e) removing the collected transfer residual components from the filters by flowing back-flush liquid from a back-flush liquid supply through the filters in a second direction opposite the first direction via a back-flush line in liquid communication with the back-flush liquid supply and with each filter bank to produce a concentrated waste liquid; and f) disposing the concentrated waste liquid back-flush to a concentrated waste container;

further comprising providing cleaning solution from the back-flush liquid supply to the cleaning subsystem via the waste collection container.

11. The method of claim 10, further comprising in step e), flowing back-flush liquid from the back-flush liquid supply independently in parallel through each filter in the respective filter bank.

12. The method of claim 10, further comprising cycling the back-flush liquid to the waste collection container, wherein the back-flush liquid is the cleaning solution.

13. The method of claim 10, further comprising measuring a pressure drop across each filter, and removing the collected transfer residual components from the filter and any other filter in the same filter bank as the measured filter in step e) based on the measurement to prevent clogging of the measured filter.

14. The method of claim 10, further comprising simultaneously providing steps c) and d) via one of the plurality of filter banks, and providing steps e) and f) via the other one of the plurality of filter banks.

15. The method of claim 14, further comprising each of the plurality of filter banks alternatively providing steps c) and d) or providing steps e) and f), with at least one of the filter banks providing steps c) and d) at all times during operation of the mechanism.

16. The method of claim 10, further comprising measuring a level of waste fluid in the waste collection container, and providing back-flush liquid flow from the back-flush liquid supply via a sump fill valve to the waste collection container as the cleaning solution based on the measurement.

17. The method of claim 10, further comprising measuring a filtering characteristic of each filter bank, and reversing the direction of liquid flow through one of the filter banks based on the measurement.

* * * * *